US008676571B2

(12) United States Patent
Otani et al.

(10) Patent No.: US 8,676,571 B2
(45) Date of Patent: Mar. 18, 2014

(54) AUDIO SIGNAL PROCESSING SYSTEM AND AUDIO SIGNAL PROCESSING METHOD

(75) Inventors: Takeshi Otani, Kawasaki (JP); Taro Togawa, Kawasaki (JP); Masanao Suzuki, Kawasaki (JP); Yasuji Ota, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 13/330,100

(22) Filed: Dec. 19, 2011

(65) Prior Publication Data

US 2012/0095755 A1 Apr. 19, 2012

Related U.S. Application Data

(63) Continuation of application No. PCT/JP2009/061221, filed on Jun. 19, 2009.

(51) Int. Cl.
*G10L 21/02* (2013.01)

(52) U.S. Cl.
USPC ..... 704/205; 704/226; 704/227; 704/228; 704/229; 704/230; 381/56; 381/71.1; 381/94.7; 455/403

(58) Field of Classification Search
USPC ..... 704/205, 226–230
See application file for complete search history.

(56) References Cited

U.S. PATENT DOCUMENTS 4,850,022 A * 7/1989 Honda et al. ..... 704/207
5,369,701 A * 11/1994 McAteer et al. ..... 379/420.02
5,579,435 A * 11/1996 Jansson ..... 704/233
5,644,596 A * 7/1997 Sih ..... 375/232
5,706,394 A * 1/1998 Wynn ..... 704/219
5,732,392 A * 3/1998 Mizuno et al. ..... 704/233
5,774,847 A * 6/1998 Chu et al. ..... 704/237
5,839,101 A * 11/1998 Vahatalo et al. ..... 704/226
6,427,134 B1 * 7/2002 Garner et al. ..... 704/233
6,453,285 B1 * 9/2002 Anderson et al. ..... 704/210

(Continued)

FOREIGN PATENT DOCUMENTS

CN 1116011 A 1/1996
JP 4-54960 9/1992

(Continued)

OTHER PUBLICATIONS

J. L. Shen, J. W. Hung, and L. S. Lee, "Robust Entropy-based Endpoint Detection for Speech Recognition in Noisy Environments" in the proceedings of the International Conference on Spoken Language Processing (ICSLP)-98, 1998.*

(Continued)

*Primary Examiner* — Pierre-Louis Desir
*Assistant Examiner* — Fariba Sirjani
(74) *Attorney, Agent, or Firm* — Staas & Halsey LLP

(57) ABSTRACT

An audio signal processing system including a time-frequency conversion unit which converts an audio signal in time domain into frequency domain in frame units so as to calculate a frequency spectrum of the audio signal, a spectral change calculation unit which calculates an amount of change between a frequency spectrum of a first frame and a frequency spectrum of a second frame before the first frame based on the frequency spectrum of the first frame and the frequency spectrum of the second frame, and a judgment unit which judges the type of the noise which is included in the audio signal of the first frame in accordance with the amount of spectral change.

10 Claims, 9 Drawing Sheets

(56) References Cited

U.S. PATENT DOCUMENTS

| | | | | |
|---|---|---|---|---|
| 6,885,752 | B1 * | 4/2005 | Chabries et al. | 381/321 |
| 7,117,150 | B2 * | 10/2006 | Murashima | 704/233 |
| 7,242,763 | B2 * | 7/2007 | Etter | 379/406.14 |
| 7,330,500 | B2 * | 2/2008 | Kouki | 375/219 |
| 7,343,016 | B2 * | 3/2008 | Kim | 381/71.12 |
| 7,590,524 | B2 * | 9/2009 | Kim | 704/208 |
| 7,856,353 | B2 * | 12/2010 | Fukuda et al. | 704/211 |
| 7,873,114 | B2 * | 1/2011 | Lin | 375/285 |
| 7,912,567 | B2 * | 3/2011 | Chhatwal et al. | 700/94 |
| 7,917,358 | B2 * | 3/2011 | Rogers | 704/226 |
| 8,085,959 | B2 * | 12/2011 | Chabries et al. | 381/312 |
| 8,111,833 | B2 * | 2/2012 | Seydoux | 381/71.1 |
| 8,175,291 | B2 * | 5/2012 | Chan et al. | 381/94.7 |
| 8,194,882 | B2 * | 6/2012 | Every et al. | 381/94.1 |
| 8,380,497 | B2 * | 2/2013 | Mohammad et al. | 704/226 |
| 8,380,500 | B2 * | 2/2013 | Yamamoto et al. | 704/233 |
| 2003/0023421 | A1 * | 1/2003 | Finn et al. | 704/1 |
| 2004/0133371 | A1 * | 7/2004 | Ziarani | 702/70 |
| 2004/0264706 | A1 * | 12/2004 | Ray et al. | 381/71.11 |
| 2005/0096915 | A1 * | 5/2005 | Suzuki et al. | 704/278 |
| 2005/0143988 | A1 | 6/2005 | Endo et al. | |
| 2006/0025992 | A1 * | 2/2006 | Oh | 704/226 |
| 2006/0136199 | A1 * | 6/2006 | Nongpiur et al. | 704/207 |
| 2007/0232257 | A1 * | 10/2007 | Otani et al. | 455/403 |
| 2008/0027716 | A1 * | 1/2008 | Rajendran et al. | 704/210 |
| 2008/0091415 | A1 * | 4/2008 | Schafer | 704/200.1 |
| 2008/0219472 | A1 * | 9/2008 | Chhatwal et al. | 381/94.3 |
| 2008/0240282 | A1 * | 10/2008 | Lin | 375/285 |
| 2009/0012783 | A1 * | 1/2009 | Klein | 704/226 |
| 2009/0043574 | A1 * | 2/2009 | Gao et al. | 704/223 |
| 2009/0089054 | A1 * | 4/2009 | Wang et al. | 704/233 |
| 2009/0164210 | A1 * | 6/2009 | Su et al. | 704/219 |
| 2009/0254341 | A1 * | 10/2009 | Yamamoto et al. | 704/233 |
| 2009/0287482 | A1 * | 11/2009 | Hetherington | 704/226 |
| 2009/0299742 | A1 * | 12/2009 | Toman et al. | 704/233 |
| 2010/0014681 | A1 * | 1/2010 | Sugiyama | 381/56 |
| 2010/0027820 | A1 * | 2/2010 | Kates | 381/312 |
| 2010/0250246 | A1 * | 9/2010 | Matsumoto | 704/208 |
| 2011/0188699 | A1 * | 8/2011 | Shibaoka et al. | 381/428 |
| 2011/0305345 | A1 * | 12/2011 | Bouchard et al. | 381/23.1 |
| 2012/0059650 | A1 * | 3/2012 | Faure et al. | 704/226 |
| 2012/0095755 | A1 * | 4/2012 | Otani et al. | 704/205 |
| 2012/0179462 | A1 * | 7/2012 | Klein | 704/226 |

FOREIGN PATENT DOCUMENTS

| | | |
|---|---|---|
| JP | 5-291971 | 11/1993 |
| JP | 9-90974 | 4/1997 |
| JP | 2000-163099 | 6/2000 |
| JP | 2004-240214 | 8/2004 |
| JP | 2004-354589 | 12/2004 |
| JP | 2005-165021 | 6/2005 |
| JP | 2005-292812 | 10/2005 |

OTHER PUBLICATIONS

P. Renevey and A. Drygajlo, "Entropy Based Voice Activity Detection in Very Noisy Conditions" in the proceedings of Eurospeech 2001, pp. 1887-1890, Sep. 2001.*

L. S. Huang and C. H. Yang "A Novel Approach to Robust Speech Endpoint Detection in Car Environments" in the proceedings of the International Conference on Acoustics, Speech, and Signal Processing (ICASSP) 2000, vol. 3, pp. 1751-1754, Jun. 2000.*

International Search Report for PCT/JP2009/061221 mailed Aug. 25, 2009.

Kajio et al., "Human Speech Like Zatsuon ni Fukumareru Onseiteki Tokucho no Bunseki" Journal of the Acoustical Society of Japan, vol. 53, No. 5, May 1997, pp. 337-345.

Office Action issued Aug. 2, 2013 in corresponding Chinese Application No. 200980159921.X.

* cited by examiner

AUDIO SIGNAL PROCESSING SYSTEM AND AUDIO SIGNAL PROCESSING METHOD

CROSS-REFERENCE TO RELATED APPLICATION

This application is a continuation application and is based upon PCT/JP2009/61221, filed on Jun. 19, 2009, the entire contents of which are incorporated herein by reference.

FIELD

The embodiments which are disclosed here relate to an audio signal processing system and audio signal processing method.

BACKGROUND

In recent years, mobile phones and other devices which reproduce sound have mounted noise suppressors for suppressing noise included in the received audio signal so as to improve the quality of the reproduced sound. To improve the quality of the reproduced sound, a noise suppressor preferably accurately discriminates between the voice of the speaker or other audio signal to originally be reproduced and noise.

Therefore, art is being developed for analyzing a frequency spectrum of an audio signal so as to judge the type of sound which is included in the audio signal (for example, see Japanese Laid-Open Patent Publication No. 2004-240214, Japanese Laid-Open Patent Publication No. 2004-354589 and Japanese Laid-Open Patent Publication No. 9-90974).

However, it is difficult to detect noise of the combined speaking voices of a plurality of persons conversing in the background, that is, "babble noise". For this reason, when an audio signal includes babble noise, sometimes the noise suppressor cannot effectively suppress the babble noise.

Therefore, art has been proposed for separately detecting babble noise from other noise (for example, see Japanese Laid-Open Patent Publication No. 5-291971).

SUMMARY

In the known art for detecting babble noise, for example, when a frequency component of the input audio signal satisfies the following judgment conditions, it is judged that the input audio signal includes babble noise. The judgment conditions are that a power of a low band component which is included in a frequency range of 1 kHz or less is high, a power of a high band component which is included in a frequency range higher than 1 kHz is not 0, and a power fluctuation of the high band component is higher than a rate related to normal conversation.

However, sound which is generated from a sound source different from "babble noise" sometimes also satisfies the above judgment conditions. For example, when there is a sound source, like an automobile which passes behind a person using a mobile phone, which moves at a relatively high speed relative to a microphone picking up an audio signal, the volume of the sound which the sound source generates, will greatly fluctuate in a short time period. For this reason, the sound which a sound source which moves at a relatively high speed relative to a microphone generates or the mixed sound of the sound generated by that sound source and the voice of a speaking party is liable to satisfy the above judgment conditions and be mistakenly judged as babble noise.

Further, if a voice different from babble noise is mistakenly judged as babble noise, the noise suppressor cannot suitably suppress noise, so the quality of the reproduced sound may degrade.

According to one aspect, there is provided an audio signal processing system. This audio signal processing system includes: a time-frequency conversion unit which converts an audio signal in time domain into frequency domain in frame units so as to calculate a frequency spectrum of the audio signal, a spectral change calculation unit which calculates an amount of change between a frequency spectrum of a first frame and a frequency spectrum of a second frame before the first frame based on the frequency spectrum of the first frame and the frequency spectrum of the second frame, and a judgment unit which judges the type of the noise which is included in the audio signal of the first frame in accordance with the amount of spectral change.

According to another embodiment, an audio signal processing method is provided. This audio signal processing method includes: converting the audio signal in time domain into frequency domain in frame units so as to calculate the frequency spectrum of an audio signal, calculating the amount of change between the frequency spectrum of a first frame and the frequency spectrum of a second frame before the first frame based on the frequency spectrum of the first frame and the frequency spectrum of the second frame, and judging the type of the noise which is included in the audio signal of the first frame in accordance with the amount of spectral change.

The objects and advantages of the present application are realized and achieved by the elements and combinations thereof which are particularly pointed out in the claims.

The above general description and the following detailed description are both illustrative and explanatory in nature. It should be understood that they do not limit the application like the claims.

DESCRIPTION OF EMBODIMENTS

Below, an audio signal processing system according to a first embodiment will be explained with reference to the drawings.

This audio signal processing system examines changes along with time in the waveform of a frequency spectrum of an input audio signal so as to judge if babble noise is included. Further, this audio signal processing system attempts to improve the quality of the reproduced sound when judging that babble noise is included, by reducing the power of the noise which is included in the audio signal from the case where the audio signal includes other noise.

Figure 1:
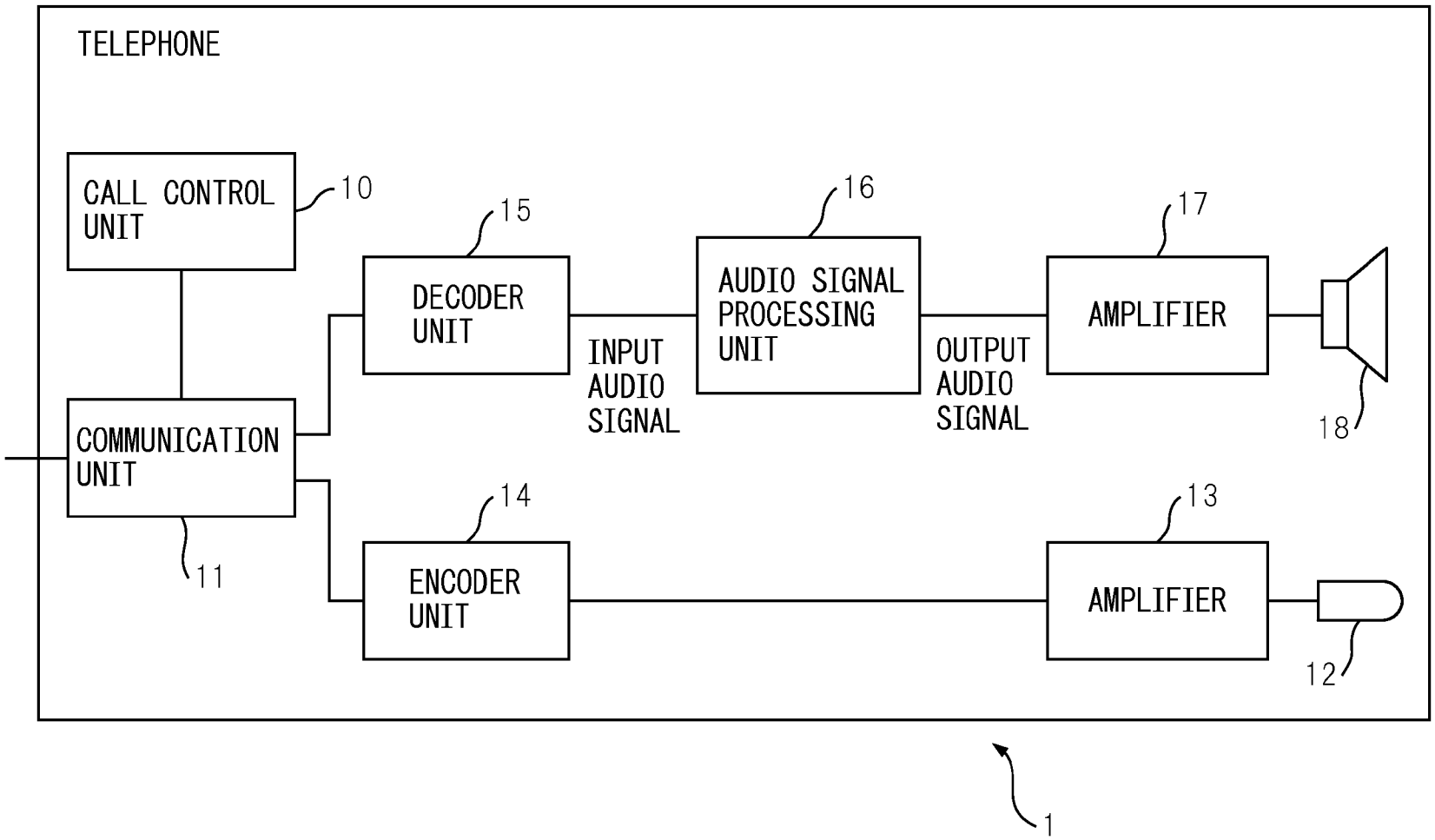
FIG. 1 is a schematic view of the configuration of a telephone in which an audio signal processing system according to a first embodiment is mounted.

FIG. 1 is a schematic view of the configuration of a telephone in which an audio signal processing system according to a first embodiment is mounted. As illustrated in FIG. 1, a telephone 1 includes a call control unit 10, a communication unit 11, a microphone 12, amplifiers 13 and 17, an encoder unit 14, a decoder unit 15, an audio signal processing system 16, and a speaker 18.

Among these, the call control unit 10, the communication unit 11, encoder unit 14, the decoder unit 15, and the audio signal processing system 16 are formed as separate circuits. Alternatively, these components may be mounted at the telephone 1 as a single integrated circuit including circuits corresponding to these components integrated. Furthermore, these components may also be functional modules which are realized by a computer program which is run on a processor of the telephone 1.

The call control unit 10 performs call control processing such as calling, replying, and disconnection between the telephone 1 and a switching equipment or Session Initiation Protocol (SIP) server when call processing is started by operation by a user through a keypad or other operating unit (not shown) of the telephone 1. Further, the call control unit 10 instructs the start or end of operation to the communication unit 11 in accordance with the results of the call control processing.

The communication unit 11 converts an audio signal which is picked up by the microphone 12 and encoded by the encoder unit 14 to a transmission signal based on a predetermined communication standard. Further, the communication unit 11 outputs this transmission signal to a communication line. Further, the communication unit 11 receives a signal based on a predetermined communication standard from a communication line and takes out the encoded audio signal from the receives signal. Further, the communication unit 11 transfers the encoded audio signal to the decoder unit 15. Note, the predetermined communication standard, for example, can be made the Internet Protocol (IP), while the transmission signal and reception signal may be IP packet signals.

The encoder unit 14 encodes the audio signal which is picked up by the microphone 12, amplified by the amplifier 13, and converted by an analog-digital converter (not shown) from an analog to digital format. For this reason, the encoder unit 14 can use, for example, the audio encoding technology defined in Recommendation G.711, G722.1, or G.729A of the International Telecommunication Union Telecommunication Standardization Sector (ITU-T).

The encoder unit 14 transfers the encoded audio signal to the communication unit 11.

The decoder unit 15 decodes the encoded audio signal which it receives from the communication unit 11. Further, the decoder unit 15 transfers the decoded audio signal to the audio signal processing system 16.

The audio signal processing system 16 analyzes the audio signal which it receives from the decoder unit 15 and suppresses noise which is contained in that audio signal. Further, the audio signal processing system 16 judges if the noise which is contained in the audio signal received from the decoder unit 15 is babble noise. Further, the audio signal processing system 16 executes noise suppression processing which differs according to the type of the noise which is contained in the audio signal.

The audio signal processing system 16 outputs the audio signal which was processed to suppress noise to the amplifier 17.

The amplifier 17 amplifies the audio signal which it receives from the audio signal processing system 16. Further, the audio signal which is output from the amplifier 17 is converted by a digital-analog converter (not shown) from a digital to analog format. Further, the analog audio signal is input to the speaker 18.

The speaker 18 reproduces the audio signal which it receives from the amplifier 17.

Here, the differences between the properties of the babble noise and the properties of other noise, for example, steady noise, will be explained.

Figure 2A:
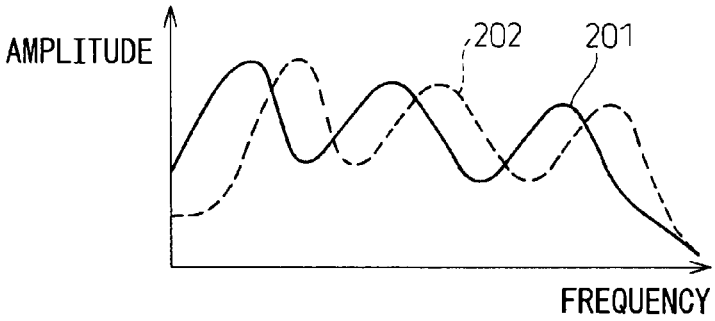
FIG. 2A is a view illustrating one example of a change along with time of the frequency spectrum with respect to babble noise.
Figure 2B:
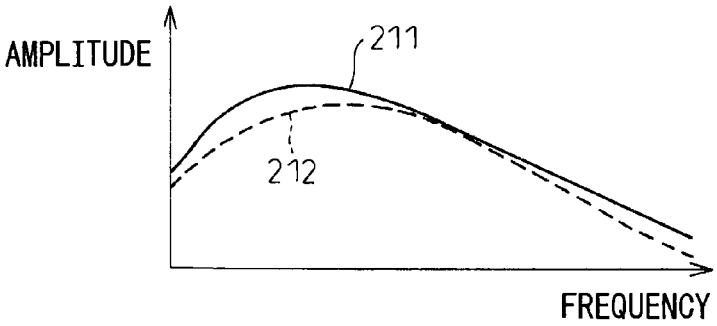
FIG. 2B is a view illustrating one example of a change along with time of the frequency spectrum with respect to steady noise.

FIG. 2A is a view illustrating one example of the change along with time of the frequency spectrum with respect to babble noise, while FIG. 2B is a view illustrating one example of a change along with time of the frequency spectrum with respect to steady noise.

In FIG. 2A and FIG. 2B, the abscissa indicates the frequency, while the ordinate indicates the amplitude of the frequency spectrum of noise. Further, in FIG. 2A, the graph 201 illustrates an example of the waveform of the frequency spectrum of babble noise at the time t. On the other hand, the graph 202 illustrates an example of the waveform of the frequency spectrum of babble noise at the time (t−1) a predetermined time before the time t. Further, in FIG. 2B, the graph 211 illustrates an example of the waveform of the frequency spectrum of steady noise at the time t. On the other hand, the graph 212 illustrates an example of the waveform of the frequency spectrum of steady noise at the time (t−1).

Babble noise includes a plurality of human voices combined together, so that the babble noise includes a plurality of audio signals of different pitch frequencies superposed. For this reason, the frequency spectrum greatly fluctuates in a short time period. In particular, the greater the number of human voices superposed, the more the frequency spectrum tends to change. Therefore, as illustrated in FIG. 2A, the waveform 201 of the frequency spectrum of the babble noise at the time t and the waveform 202 of the frequency spectrum of the babble noise at the time (t−1) greatly differ.

As opposed to this, the waveform of steady noise does not fluctuate that much during a short time period. For this reason, as illustrated in FIG. 2B, the waveform 211 of the frequency spectrum of the steady noise at the time t and the waveform 212 of the frequency spectrum of the steady noise at the time (t−1) are substantially equal. For example, even if the distance between the sound source which generates noise and the microphone which picks up speech, changes between the time t and the time (t−1), the intensity of the frequency spectrum becomes stronger or weaker overall, but the waveform of the frequency spectrum of the steady noise itself does not change much.

Therefore, the audio signal processing system 16 can examine the change in time of the waveform of the frequency spectrum of the input audio signal to thereby judge if the noise which is contained in the input audio signal is babble noise or not.

Figure 3:
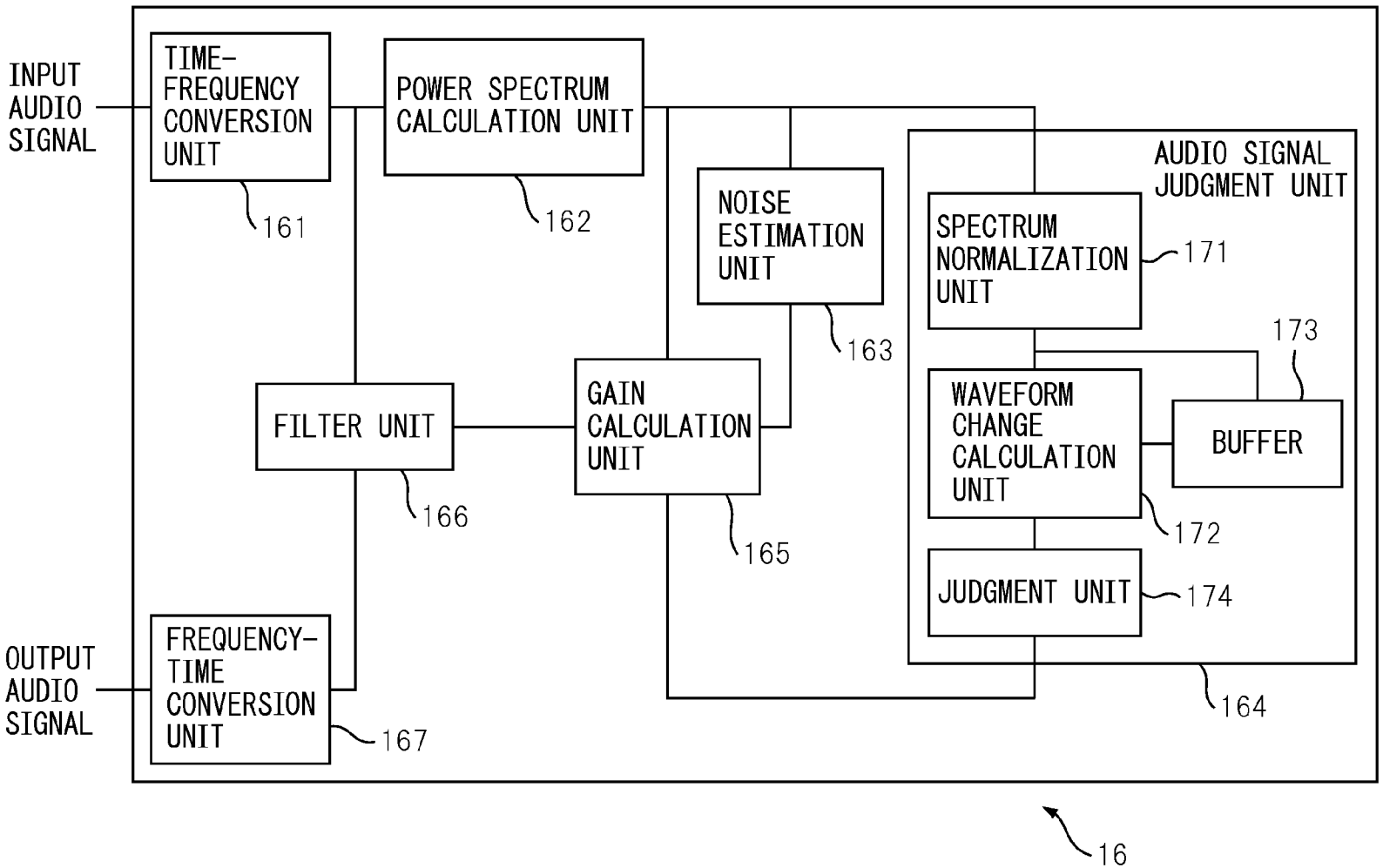
FIG. 3 is a schematic view of the configuration of an audio signal processing system according to the first embodiment.

FIG. 3 is a schematic view of the configuration of the audio signal processing system 16. As illustrated in FIG. 3, the audio signal processing system 16 includes a time-frequency conversion unit 161, a power spectrum calculation unit 162, a noise estimation unit 163, an audio signal judgment unit 164, a gain calculation unit 165, a filter unit 166, and a frequency-time conversion unit 167. These components of the audio signal processing system 16 are formed as separate circuits. Alternatively, these components of the audio signal processing system 16 may be mounted in the audio processing system 16 as a single integrated circuit including circuits corresponding to these components integrated together. Furthermore, these components of the audio signal processing system 16 may also be functional modules which are realized by a computer program which is run on a processor of the audio signal processing system 16.

The time-frequency conversion unit 161 converts the audio signal which is input to the audio signal processing system 16, to the frequency spectrum by transforming the input audio signal in time domain into frequency domain in frame units. The time-frequency conversion unit 161 can convert the input audio signal to the frequency spectrum using, for example, a Fast Fourier transform, discrete cosine transform, modified discrete cosine transform, or other time-frequency conversion processing. Note, the frame length can be made, for example, 200 msec.

The time-frequency conversion unit 161 transfers the frequency spectrum to the power spectrum calculation unit 162.

The power spectrum calculation unit 162 may calculate the power spectrum of the frequency spectrum each time receiving a frequency spectrum from the time-frequency conversion unit 161.

Note, the power spectrum calculation unit 162 calculates the power spectrum according to the following formula:

$$S(f)=10\log_{10}(|X(f)|^2) \tag{1}$$

Here, f is the frequency, while the function X(f) is a function indicating the amplitude of the frequency spectrum with respect to the frequency f. Further, the function S(f) is a function indicating the intensity of the power spectrum with respect to the frequency f.

The power spectrum calculation unit 162 outputs the calculated power spectrum to the noise estimation unit 163, audio signal judgment unit 164, and gain calculation unit 165.

The noise estimation unit 163 calculates an estimated noise spectrum corresponding to the noise component which is contained in the audio signal from the power spectrum each time receiving a power spectrum of each frame. In general, the distance between the sound source of the noise and the microphone which picks up the audio signal which is input to the telephone 1, is further than the distance between the microphone and the person speaking into the microphone. For this reason, the power of the noise component is smaller than the power of the voice of the speaking person. Therefore, the noise estimation unit 163 can calculate the estimated noise spectrum for a frame with a small power spectrum, among the frames of the audio signal which is input to the telephone 1, by calculating the average value of the powers for sub frequency bands obtained by dividing the frequency band in which the input signal is contained. Note, the width of a sub frequency band can, for example, be the width obtained dividing the range from 0 Hz to 8 kHz into 1024 equal sections or 256 equal sections.

Specifically, the noise estimation unit 163 can calculate the average value p of the power spectrums of the entire frequency band contained in the audio signal which is input to the telephone for the latest frame in accordance with the time order of the frames, in accordance with the following formula.

$$p=\frac{1}{M}\sum_{f=flow}^{fhigh}(S(f)) \tag{2}$$

Here, M is the number of the sub frequency bands. Further, $f_{low}$ indicates the lowest sub frequency band, while $f_{high}$ indicates the highest sub frequency band. Next, the noise estimation unit 163 compares the average value p of the power spectrums of the latest frame and the threshold value Thr corresponding to the upper limit of the power of the noise component. Note, the threshold value Thr may be, for example, set to any value in the range of 10 dB to 20 dB. Further, the noise estimation unit 163 calculates the estimated noise spectrum $N_m(f)$ for the latest frame by averaging the power spectrums in the time direction for the sub frequency bands in accordance with the following formula when the average value p is less than the threshold value Thr.

$$N_m(f)=\alpha\cdot N_{m-1}(f)+(1-\alpha)\cdot S(f) \tag{3}$$

Here, $N_{m-1}(f)$ is the estimated noise spectrum for one frame before the latest frame and is read from a buffer of the noise estimation unit 163. Further, the coefficient α may be, for example, set to any value of 0.9 to 0.99. On the other hand, when the average value p is the threshold value Thr or more, it is estimated that the latest frame contains components other than noise, so the noise estimation unit 163 does not update the estimated noise spectrum. That is, the noise estimation unit 163 makes $N_m(f)=N_{m-1}(f)$.

Note, instead of calculating the average value p of the power spectrums, the noise estimation unit 163 may find the maximum value in the power spectrums of all sub frequency bands and compare the maximum value with the threshold value Thr.

The noise estimation unit 163 outputs the estimated noise spectrum to the gain calculation unit 165. Further, the noise estimation unit 163 stores the estimated noise spectrum for the latest frame to the buffer of the noise estimation unit 163.

The audio signal judgment unit 164 judges the type of the noise which is contained in a frame when receiving the power spectrum of the frame. For this reason, the audio signal judgment unit 164 includes a spectral normalization unit 171, a waveform change calculation unit 172, a buffer 173, and a judgment unit 174.

The spectral normalization unit 171 normalizes the received power spectrum. For example, the spectral normalization unit 171 may calculate the normalized power spectrum S'(f) in accordance with the following formula so that the intensity of the normalized power spectrum S'(f) corresponding to the average value of the power spectrums in the sub frequency bands becomes 1.

$$S'(f)=\frac{S(f)}{\frac{1}{M}\sum_{f=flow}^{fhigh}(S(f))} \tag{4}$$

Alternatively, the spectral normalization unit 171 may calculate the normalized power spectrum S'(f) in accordance with the following formula so that the intensity of the normalized power spectrum S'(f) corresponding to the maximum value of the power spectrums in the sub frequency band becomes 1.

$$S'(f) = \frac{S(f)}{\max_{flow}^{fhigh}(S(f))} \quad (5)$$

Here, the function max(S(f)) is a function which outputs the maximum value of the power spectrums of the sub frequency bands which are contained in the range from the sub frequency band $f_{low}$ to $f_{high}$.

The spectral normalization unit 171 outputs the normalized power spectrum to the waveform change calculation unit 172. Further, the spectral normalization unit 171 stores the normalized power spectrum at the buffer 173.

The waveform change calculation unit 172 calculates the amount of change of the waveform of the normalized power spectrum in the time direction as the amount of waveform change. As explained relating to FIG. 2A and FIG. 2B, the waveform of the frequency spectrum of the babble noise fluctuates in a shorter time compared with the waveform of the frequency spectrum of steady noise. For this reason, the amount of change of this waveform is information useful for judging the type of noise which is contained in an audio signal.

Therefore, when receiving the normalized power spectrum $S'_m(f)$ of the latest frame from the spectral normalization unit 171, the waveform change calculation unit 172 reads out the normalized power spectrum $S'_{m-1}(f)$ of one frame before from the buffer 173. Further, the waveform change calculation unit 172 calculates the total of the absolute values of the differences between the two normalized power spectrums $S'_m(f)$ and $S'_{m-1}(f)$ at the sub frequency bands in accordance with the next formula as the amount of waveform change Δ.

$$\Delta = \sum_{f=flow}^{fhigh} |S'_m(f) - S'_{m-1}(f)| \quad (6)$$

Note, the waveform change calculation unit 172 may also make the amount of waveform change Δ the total of the absolute values of the differences of the normalized power spectrum of the latest frame and the normalized power spectrum of the frame a predetermined number of frames, at least two, before the latest frame, at the sub frequency bands. Note, the "predetermined number", for example, may be made any of 2 to 5. By setting the time interval between two frames for calculating the amount of waveform change in this way, it becomes easy to distinguish between the amount of waveform change for the babble noise comprised of the plurality of human voices combined and the amount of waveform change of the voice of one speaker.

Further, the waveform change calculation unit 172 may calculate as the amount of waveform change Δ the square sum of the difference between the two normalized power spectrums $S'_m(f)$ and $S'_{m-1}(f)$ at each sub frequency band.

The waveform change calculation unit 172 outputs the amount of waveform change Δ to the judgment unit 174.

The buffer 173 stores the normalized power spectrums up to the frame a predetermined number of frames before the latest frame. Further, the buffer 173 erases normalized power spectrums further in the past from the predetermined number.

The judgment unit 174 judges if babble noise is contained in the audio signal for the latest frame.

As explained above, if the audio signal contains babble noise, the amount of waveform change Δ is large, while if the audio signal does not contain babble noise, the amount of waveform change Δ is small.

Therefore, the judgment unit 174 judges that babble noise is contained in the audio signal for the latest frame when the amount of waveform change Δ is larger than the predetermined threshold value Thw. On the other hand, the judgment unit 174 judges that babble noise is not contained in the audio signal for the latest frame when the amount of waveform change Δ is the predetermined threshold value Thw or less. Note, the predetermined threshold value Thw is preferably set to an amount of waveform change corresponding to a single human voice. The pitch frequency of babble noise is shorter than the pitch frequency of one human voice, so by having the threshold value Thw set in this way, the judgment unit 174 can accurately detect the babble noise. Further, the predetermined threshold value Thw may also be set to the optimum value found experimentally. For example, the predetermined threshold value Thw may be made any value from 2 dB to 3 dB when the amount of waveform change Δ is the sum of the absolute values of the difference between the two normal power spectrums at each frequency band. Further, when the amount of waveform change Δ is the square sum of the difference between two normalized power spectrums at the frequency bands, the predetermined threshold value Thw can be made any value from 4 dB to 9 dB.

The judgment unit 174 notifies the result of judgment of the type of noise which is contained in the audio signal of the latest frame to the gain calculation unit 165.

The gain calculation unit 165 determines the gain to be multiplied with the power spectrum in accordance with the estimated noise spectrum and the results of judgment of the type of the noise which is contained in the audio signal by the audio signal judgment unit 164. Here, the power spectrum corresponding to the noise component is relatively small and the power spectrum corresponding to the voice of a speaking person is relatively large.

Therefore, when it is judged that babble noise is contained in the audio signal of the latest frame, the gain calculation unit 165 judges whether the power spectrum S(f) is smaller than the noise spectrum N(f) plus the babble noise bias value Bb (N(f)+Bb) for each sub frequency band. Further, the gain calculation unit 165 sets the gain value G(f) of the sub frequency band with an S(f) smaller than (N(f)+Bb) to a value where the power spectrum will attenuate, for example, 16 dB. On the other hand, when S(f) is (N(f)+Bb) or more, the gain calculation unit 165 determines the gain value G(f) so that the attenuation rate of the frequency spectrum of the sub frequency band becomes smaller. For example, the gain calculation unit 165 sets the gain value G(f) to any value from 0 dB to 1 dB when S(f) is (N(f)+Bb) or more.

Further, when it is judged that babble noise is not contained in the audio signal of the latest frame, the gain calculation unit 165 judges whether the power spectrum S(f) is smaller than the noise spectrum N(f) plus the bias value Bc (N(f)+Bc) for each sub frequency band. Further, the gain calculation unit 165 sets the gain value G(f) of the sub frequency band with an S(f) smaller than (N(f)+Bc) to a value where the power spectrum will attenuate, for example, 10 dB. On the other hand, when S(f) is (N(f)+Bc) or more, the gain calculation unit 165 sets the gain value G(f) to any value from 0 dB to 1 dB so that the attenuation rate of the frequency spectrum of the sub frequency band becomes smaller.

With babble noise, the waveform of the spectrum fluctuates greatly in a short time period, so the power spectrum of babble noise can become a value considerably larger than the estimated noise spectrum. On the other hand, with other noise, the waveform of the spectrum does not fluctuate greatly in a short time period, so the difference between the power spectrum of noise other than babble noise and the estimated noise spectrum is small. For this reason, the bias value Bc is preferably set to a value smaller than the babble noise bias value Bb. For example, the bias value Bc is set to 6 dB, while the babble noise bias value Bb is set to 12 dB.

Further, when there is babble noise in the background, the voice of a speaking person becomes harder to understand compared with the case where there is other noise. Therefore, the gain calculation unit 165 preferably sets the gain value of the case where it is judged that babble noise is contained in the audio signal of the latest frame to a value larger than the gain value of the case where it is judged that babble noise is not contained in the audio signal of the latest frame. For example, the gain value of the case where it is judged that babble noise is contained in the audio signal of the latest frame is set to 16 dB, while the gain value of the case where it is judged that babble noise is not contained in the audio signal of the latest frame is set to 10 dB.

Alternatively, the gain calculation unit 165 may use the method which is disclosed in Japanese Laid-Open Patent Publication No. 2005-165021 or another method to distinguish the noise component contained in an audio signal from other components and determine the gain value in accordance with each component for each sub frequency band. For example, the gain calculation unit 165 estimates the distribution of the power spectrum of a pure audio signal not containing noise from the average value and dispersion of the power spectrum of about the top 10% of the frames of a recent predetermined number of frames (for example, 100 frames). Further, the gain calculation unit 165 determines the gain value so that the gain value becomes larger the larger the difference of the power spectrum of the audio signal and the estimated power spectrum of a pure audio signal for each sub frequency band.

The gain calculation unit 165 outputs the gain value determined for each sub frequency band to the filter unit 166.

The filter unit 166 performs filtering to reduce the frequency spectrum corresponding to noise for each frequency band using the gain value determined by the gain calculation unit 165 every time receiving the frequency spectrum of the input audio signal from the time-frequency conversion unit 161.

For example, the filter unit 166 performs filtering for each sub frequency band in accordance with the following formula:

$$Y(f)=10^{-G(f)/20}\cdot X(f) \tag{7}$$

Here, X(f) indicates the frequency spectrum of the audio signal. Further, Y(f) is the frequency spectrum on which filter processing is performed. As clear from formula (7), the larger the gain value, the more attenuated the Y(f).

The filter unit 166 outputs the frequency spectrum reduced in noise to the frequency-time change unit 167.

The frequency-time conversion unit 167 obtains an audio signal reduced in noise by transforming the frequency spectrum in frequency domain into time domain each time obtaining a frequency spectrum reduced in noise by the filter unit 166. Note, the frequency-time conversion unit 167 uses inverse transformation of the time-frequency transformation which is used by the time-frequency conversion unit 161.

The frequency-time conversion unit 167 outputs the audio signal reduced in noise to the amplifier 17.

Figure 4:
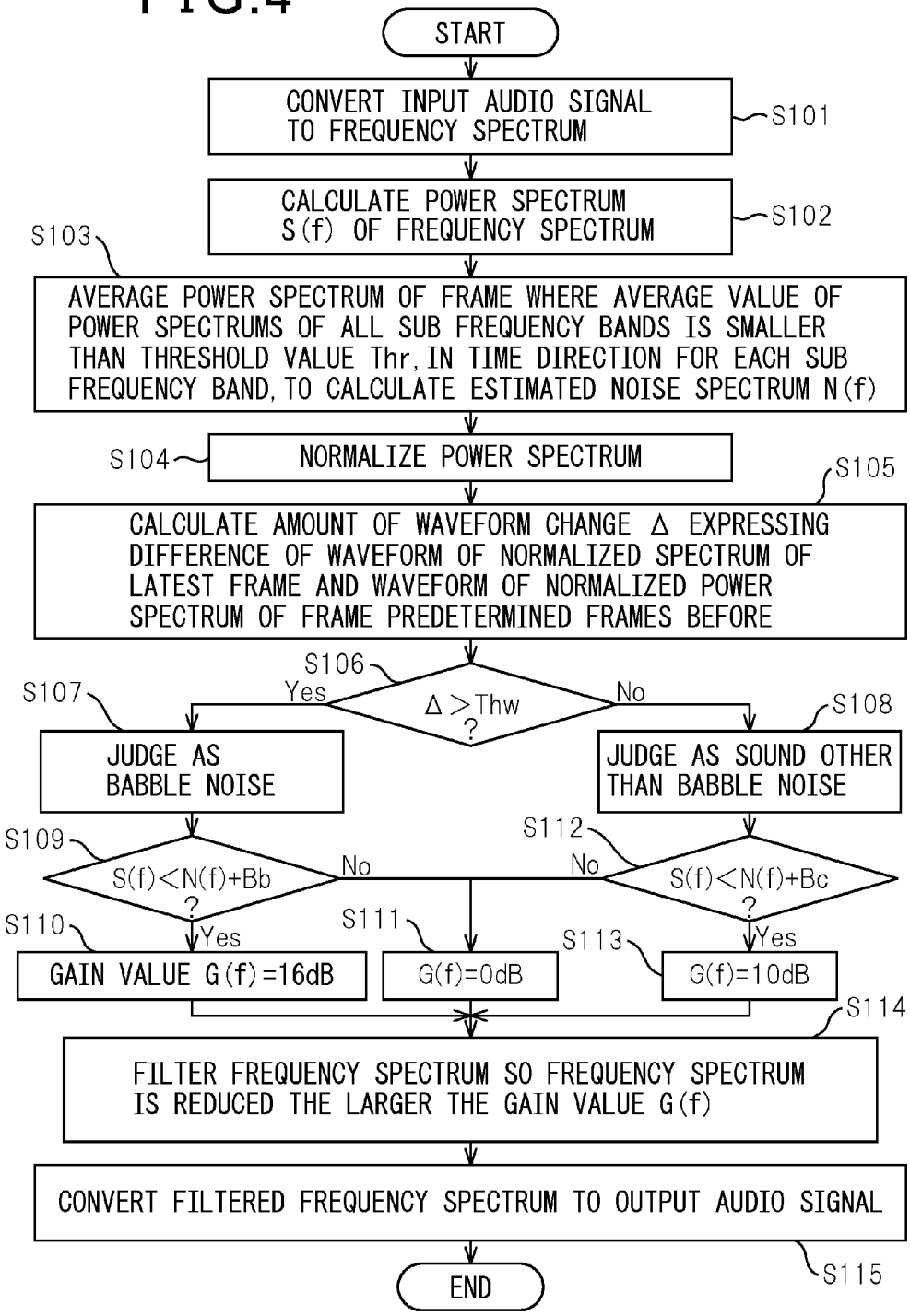
FIG. 4 is a view illustrating a flow chart of the operation for noise reduction processing for an input audio signal.

FIG. 4 illustrates a flow chart of the operation for noise reduction processing for an input audio signal.

Note, the audio signal processing system 16 repeatedly performs the noise reduction processing which is illustrated in FIG. 4 in frame units. Further, the gain value which is mentioned in the following flow chart is one example. It may be another value as explained relating to the gain calculation unit 165.

First, the time-frequency conversion unit 161 converts the input audio signal to the frequency spectrum by transforming the input audio signal in time domain into frequency domain in frame units (step S101). The time-frequency conversion unit 161 transfers the frequency spectrum to the power spectrum calculation unit 162.

Next, the power spectrum calculation unit 162 calculates the power spectrum S(f) of the frequency spectrum obtained from the time-frequency conversion unit 161 (step S102). Further, the power spectrum calculation unit 162 outputs the calculated power spectrum S(f) to the noise estimation unit 163, audio signal judgment unit 164, and gain calculation unit 165.

The noise estimation unit 163 averages the power spectrums of a frame with an average value of the power spectrums of all sub frequency bands smaller than the threshold value Thr, for each sub frequency band in the time direction, to thereby calculate the estimated noise spectrum N(f) (step S103). Further, the noise estimation unit 163 outputs the estimated noise spectrum N(f) to the gain calculation unit 165. Further, the noise estimation unit 163 stores the estimated noise spectrum N(f) for the latest frame in the buffer of the noise estimation unit 163.

On the other hand, the spectral normalization unit 171 normalizes the received power spectrum (step S104). Further, the spectral normalization unit 171 outputs the calculated normalized power spectrum S'(f) to the waveform change calculation unit 172 and stores it in the buffer 173.

The waveform change calculation unit 172 calculates the amount of waveform change Δ expressing the difference between the waveform of the normalized power spectrum of the latest frame and the waveform of the normalized power spectrum of the frame a predetermined number of frames before the latest frame read from the buffer 173 (step S105). Further, the waveform change calculation unit 172 transfers the amount of waveform change Δ to the judgment unit 174.

The judgment unit 174 judges if the amount of waveform change Δ is larger than the threshold value Thw (step S106). When the amount of waveform change Δ is larger than the predetermined threshold value Thw (step S106-Yes), the judgment unit 174 judges that the audio signal of the latest frame contains babble noise and notifies the results of the judgment to the gain calculation unit 165 (step S107). On the other hand, when the amount of waveform change Δ is a predetermined threshold value Thw or less (step S106-No), the judgment unit 174 judges that the audio signal of the latest frame does not contain babble noise and notifies the result of judgment to the gain calculation unit 165 (step S108).

After step S107, the gain calculation unit 165 judges if the power spectrum S(f) is smaller than the noise spectrum N(f) plus the babble noise bias value Bb (N(f)+Bb) (step S109). If S(f) is smaller than (N(f)+Bb) (step S109-Yes), the gain calculation unit 165 sets the gain value G(f) at 16 dB (step S110). On the other hand, if S(f) is (N(f)+Bb) or more (step S109-No), the gain calculation unit 165 sets the gain value G(f) at 0 (step S111).

On the other hand, after step S108, the gain calculation unit 165 judges if the power spectrum S(f) is smaller than the noise spectrum N(f) plus the bias value Bc (N(f)+Bc) (step S112). If S(f) is smaller than (N(f)+Bc) (step S112-Yes), the gain calculation unit 165 sets the gain value G(f) at 10 dB (step S113). On the other hand, if S(f) is (N(f)+Bc) or more (step S112-No), the gain calculation unit 165 sets the gain value G(f) at 0 (step S111).

Note, the gain calculation unit 165 performs the processing of steps S109 to S113 for each sub frequency band. Further, the gain calculation unit 165 outputs the gain value G(f) to the filter unit 166.

The filter unit 166 performs filtering for the frequency spectrum so that the frequency spectrum is reduced the larger the gain value G(f) for each sub frequency band (step S114). Further, the filter unit 166 outputs the filtered frequency spectrum to the frequency-time conversion unit 167.

The frequency-time conversion unit 167 converts the filtered frequency spectrum to an output audio signal by transforming the frequency spectrum in frequency domain into time domain (step S115). Further, the frequency-time conversion unit 167 outputs the output audio signal reduced in noise to the amplifier 17.

As explained above, the audio signal processing system according to the first embodiment can judge that the audio signal contains babble noise when the waveform of the normalized power spectrum of the input audio signal greatly fluctuates in a short time period and thereby accurately detect babble noise. Further, this audio signal processing system can improve the quality of the reproduced sound by reducing the power of the audio signal when it is judged that babble noise is included compared to when the audio signal contains other noise.

Next, the audio signal processing system according to the second embodiment will be explained.

This audio signal processing system examines the change over time of the waveform of the frequency spectrum of the audio signal which is obtained by using a microphone to pick up the sound surrounding the telephone in which the audio signal processing system is mounted to thereby judge if the sound surrounding the telephone contains babble noise. Further, this audio signal processing system, when it is judged that babble noise is contained, amplifies the power of the separately obtained audio signal to be reproduced so that the user of the telephone can easily understand the reproduced sound.

Figure 5:
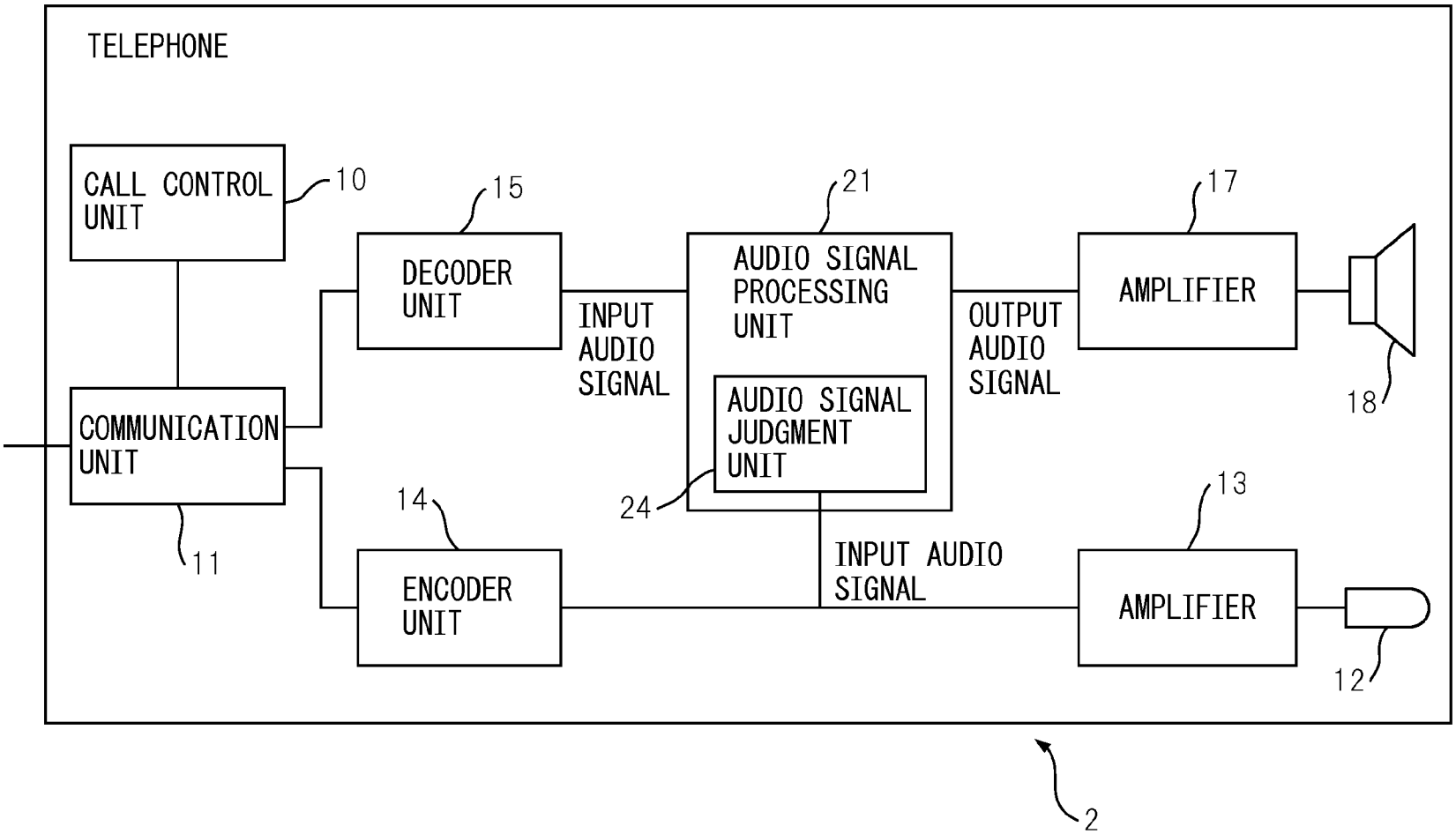
FIG. 5 is a schematic view of the configuration of a telephone in which an audio signal processing system according to a second to fourth embodiment is mounted.

FIG. 5 is a schematic view of the configuration of a telephone in which an audio signal processing system according to a second embodiment is mounted. As illustrated in FIG. 5, the telephone 2 includes a call control unit 10, communication unit 11, microphone 12, amplifiers 13, 17, encoder unit 14, decoder unit 15, audio signal processing system 21, and speaker 18. Note, the components of the telephone 2 illustrated in FIG. 5 are assigned the same reference numerals as the components corresponding to the telephone 1 illustrated in FIG. 1.

The telephone 2 differs from the telephone 1 illustrated in FIG. 1 in the point that the audio signal judgment unit 24 of the audio signal processing system 21 judges if speech which is picked up by the microphone 12 contains babble noise and uses the results of judgment to amplify the audio signal which the audio signal processing system 21 receives. Therefore, below, the audio signal processing system 21 will be explained. For the other components of the telephone 2, see the explanation of the telephone 1 illustrated in FIG. 1.

Figure 6:
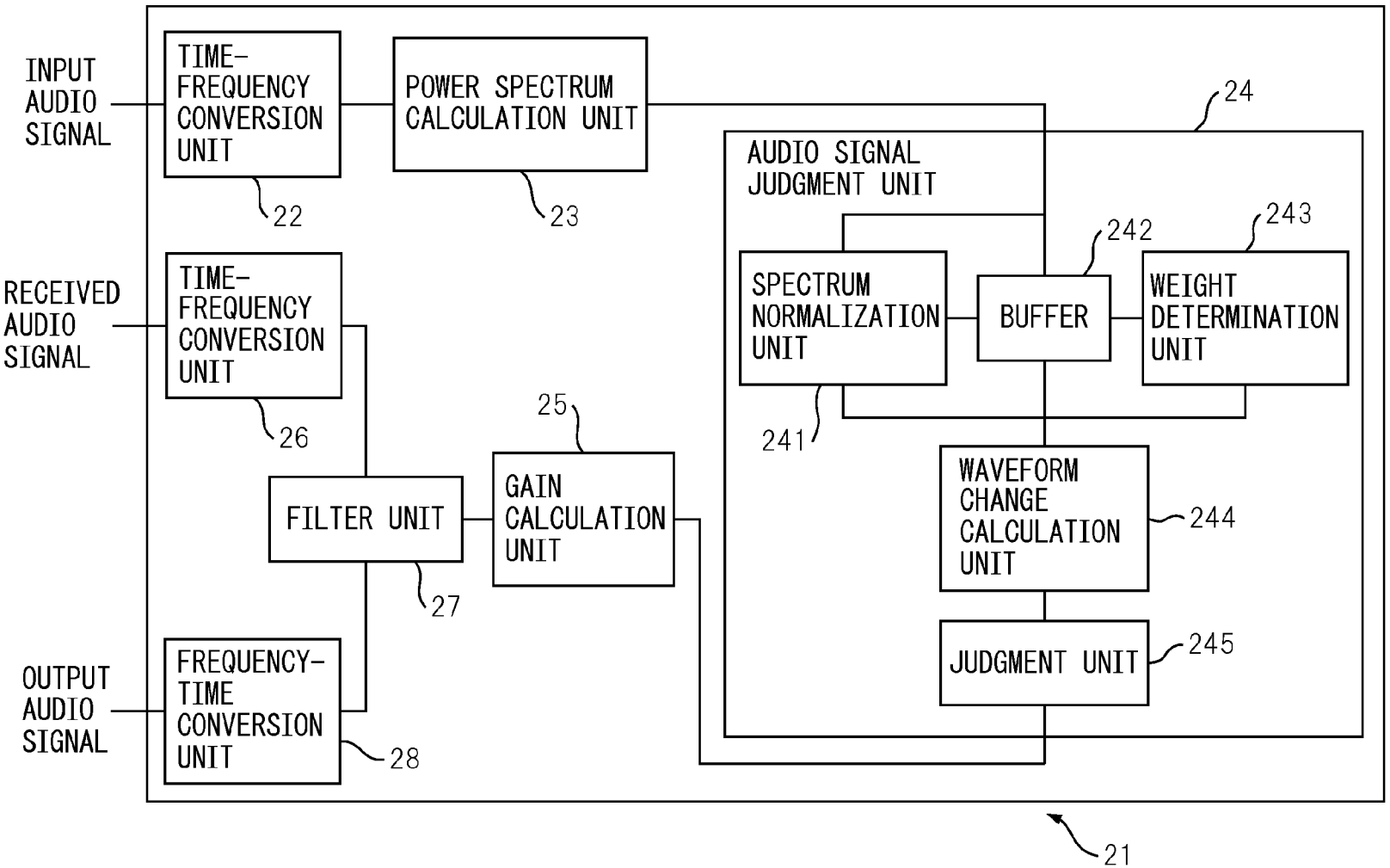
FIG. 6 is a schematic view of the configuration of an audio signal processing system according to a second embodiment.

FIG. 6 is a schematic view of the configuration of an audio signal processing system 21. As illustrated in FIG. 6, the audio signal processing system 21 includes time-frequency conversion units 22 and 26, a power spectrum calculation unit 23, audio signal judgment unit 24, gain calculation unit 25, filter unit 27, and frequency-time conversion unit 28. The components of the audio signal processing system 21 are formed as separate circuits. Alternatively, the components of the audio signal processing system 21 may also be mounted in the audio signal processing system 21 as a single integrated circuit on which circuits corresponding to these components are integrated. Further, the components of the audio signal processing system 21 may also be functional modules which are realized by a computer program which is run on a processor of the audio signal processing system 21.

The time-frequency conversion unit 22 converts the input audio signal corresponding to the sound around the telephone 2, which is picked up through the microphone 12, to the frequency spectrum by transforming the input audio signal in time domain into frequency domain in frame units. Note, the time-frequency conversion unit 22, like the time-frequency conversion unit 161 of the audio signal processing system 16 according to the first embodiment, can use a Fast Fourier transform, discrete cosine transform, modified discrete cosine transform, or other time-frequency conversion processing. Note, the frame length, for example, can be made 200 msec.

The time-frequency conversion unit 22 outputs the frequency spectrum of the input audio signal to the power spectrum calculation unit 23.

Further, the time-frequency conversion unit 26 converts the audio signal which is received through the communication unit 11, to a frequency spectrum by transforming the received audio signal in time domain into frequency domain in frame units. The time-frequency conversion unit 26 outputs the frequency spectrum of the received audio signal to the filter unit 27.

The power spectrum calculation unit 23 calculates the power spectrum of the frequency spectrum each time receiving the frequency spectrum of the input audio signal from the time-frequency conversion unit 22. The power spectrum calculation unit 23 can calculate the power spectrum using the above formula (1).

The power spectrum calculation unit 23 outputs the calculated power spectrum to the audio signal judgment unit 24.

The audio signal judgment unit 24 judges the type of the noise which is contained in the input audio signal of the frame each time receiving the power spectrum of each frame. For this reason, the audio signal judgment unit 24 includes a spectral normalization unit 241, buffer 242, weight determination unit 243, waveform change calculation unit 244, and judgment unit 245.

The spectral normalization unit 241 normalizes the received power spectrum. For example, the spectral normalization unit 241 calculates the normalized power spectrum S'(f) using the above formula 4) or formula (5).

The spectral normalization unit 241 outputs the normalized power spectrum to the waveform change calculation unit 244. Further, the spectral normalization unit 241 stores the normalized power spectrum in the buffer 242.

The buffer 242 stores the power spectrum of the input audio signal each time receiving the power spectrum from the power spectrum calculation unit 23 in frame units. Further, the buffer 242 stores the normalized power spectrum which is received from the spectral normalization unit 241.

The buffer 242 stores the power spectrum and normalized power spectrum up to the frame a predetermined number of frames before the latest frame. Further, the buffer 242 erases the power spectrums and normalized power spectrums further in the past from the predetermined number.

The weight determination unit 243 determines the weighting coefficient for each sub frequency band which is used for calculating the amount of waveform change. This weighting coefficient is set so as to become larger the higher the possibility of a babble noise component being contained in the sub frequency band. For example, if the input audio signal contains a human voice, the intensity of the power spectrum rapidly becomes larger when a person speaks. On the other hand, the human voice has the property of gradually becoming smaller in intensity. Therefore, a sub frequency band where the power spectrum becomes larger than the power spectrum of the previous frame by a predetermined offset value or more, has a high possibility of containing a component of babble noise. Therefore, the weight determination unit 243 reads the power spectrum $S_m(f)$ of the latest frame and the power spectrum $S_{m-1}(f)$ of the one previous frame from the buffer 242. Further, the weight determination unit 243 compares the power spectrum $S_m(f)$ of the latest frame and the power spectrum $S_{m-1}(f)$ of the one previous frame for each sub frequency band. Further, when the difference of the power spectrum $S_m(f)$ minus $S_{m-1}(f)$ is larger than the offset value $S_{off}$, the weight determination unit 243 sets the weighting coefficient w(f) for the sub frequency band f at, for example, 1. On the other hand, when the difference of the power spectrum $S_m(f)$ minus the $S_{m-1}(f)$ is the offset value $S_{off}$ or less, the weight determination unit 243 sets the weighting coefficient w(f) for that sub frequency band f to, for example, 0. Note, the offset value $S_{off}$ is, for example, set to any value from 0 to 1 dB.

Alternatively, the weight determination unit 243 may set the weighting coefficient w(f) of a frame with an average value of the power spectrums of the sub frequency bands larger than a predetermined threshold value to a value larger than the weighting coefficient of a frame where the average value becomes the predetermined threshold value or less. For example, the weight determination unit 243 may also determine the weighting coefficient w(f) as follows.

$$w(f) = \begin{cases} 1.0 \left( \text{case where } \frac{1}{M} \sum_{f=flow}^{f=fhigh} S(f) > Thr \right) \\ 0.0 \text{ (other cases)} \end{cases} \tag{8}$$

Here, M is the number of the sub frequency bands. Further, $f_{low}$ indicates the lowest sub frequency band, while $f_{high}$ indicates the highest sub frequency band. Further, the threshold value Thr is, for example, set to any value in the range from 10 dB to 20 dB.

Furthermore, the weight determination unit 243 may increase the weighting coefficient the larger the average value of the power spectrums of the sub frequency bands.

The weight determination unit 243 outputs the weighting coefficient w(f) for each sub frequency band to the waveform change calculation unit 244.

The waveform change calculation unit 244 calculates the amount of change of the waveform of the normalized power spectrum in the time direction, that is, the amount of waveform change.

In the present embodiment, the waveform change calculation unit 244 calculates the amount of waveform change Δ in accordance with the following formula:

$$\Delta = \sum_{f=flow}^{fhigh} w(f) \cdot |S'_m(f) - S'_{m-1}(f)| \tag{9}$$

Here, in the same way as formula (6), $S'_m(f)$ indicates the normalized power spectrum of the latest frame, while $S'_{m-1}(f)$ indicates the normalized power spectrum of the previous frame which is read from the buffer 242.

The waveform change calculation unit 244 may also make the amount of waveform change Δ the total of the absolute values of the differences between the normalized power spectrum of the latest frame and the normal power spectrum of the frame a predetermined number of frames, two or more, before the latest frame.

Alternatively, the waveform change calculation unit 244 may also make the amount of waveform change Δ the sum of the values obtained by multiplying the square of the difference between the two normalized power spectrums $S'_m(f)$ and $S'_{m-1}(f)$ at each sub frequency band with the weighting coefficient w(f).

The waveform change calculation unit 244 outputs the amount of waveform change Δ to the judgment unit 245.

The judgment unit 245 judges whether or not the audio signal of the latest frame contains babble noise.

The judgment unit 245, like the judgment unit 174 of the audio signal processing system 16 according to the first embodiment, judges that the audio signal of the latest frame contains babble noise when the amount of waveform change Δ is the predetermined threshold value Thw or more. On the other hand, the judgment unit 245 judges that the audio signal of the latest frame does not contain babble noise when the amount of waveform change Δ is the predetermined threshold value Thw or less.

In this embodiment as well, the predetermined threshold value Thw is, for example, set to a value corresponding to the amount of waveform change of a single human voice or a value found experimentally.

The judgment unit 245 notifies the result of judgment of the type of the noise which is contained in the audio signal of the latest frame to the gain calculation unit 25.

The gain calculation unit 25 determines the gain to be multiplied with the power spectrum based on the results of judgment of the type of noise according to the audio signal judgment unit 24. Here, if the input audio signal contains babble noise, there is a possibility of the area around the user of the telephone 2 being noisy and the received audio signal being hard to comprehend.

Therefore, when it is judged that the audio signal of the latest frame contains babble noise, the gain calculation unit 25 determines the gain value G(f) so as to amplify the frequency spectrum of the received audio signal uniformly for all sub frequency bands. When the audio signal of the latest frame contains babble noise, the gain calculation unit 25, for example, sets the gain value G(f) to 10 dB. On the other hand, when it is judged that the audio signal of the latest frame does not contain babble noise, the gain calculation unit 25 sets the gain value G(f) to 0.

Alternatively, the gain calculation unit 25 may use another method to determine the gain value. For example, the gain calculation unit 25 may determine the gain value so as to enhance the vocal tract characteristics separated from the received audio signal in accordance with the method disclosed in International Publication Pamphlet No. WO2004/040555. In this case, the gain calculation unit 25 separates the received audio signal into the sound source characteristics and the vocal tract characteristics. Further, the gain calculation unit 25 calculates the average vocal tract characteristics based on the weighted average of the self correlation of the current frame and the self correlation of the past frame. The gain calculation unit 25 determines the formant frequency and formant amplitude from the average vocal tract characteristics and changes the formant amplitude based on the formant frequency and formant amplitude so as to enhance the average vocal tract characteristics. At that time, the gain calculation unit 25 sets the gain value for amplifying the formant amplitude in the case where it is judged that the audio signal of the latest frame contains babble noise, to a value larger than the gain value in the case where it is judged that the audio signal of the latest frame does not contain babble noise.

The gain calculation unit 25 outputs the gain value to the filter unit 27.

The filter unit 27 performs filtering to amplify the frequency spectrum for each sub frequency band using the gain value which is determined by the gain calculation unit 25 each time receiving the frequency spectrum of the audio signal, which is received through the communication unit 11, from the time-frequency conversion unit 161.

For example, the filter unit 27 performs filtering in accordance with the following formula for each sub frequency band.

$$Y(f)=10^{G(f)/20}\cdot X(f) \tag{10}$$

Here, X(f) indicates the frequency spectrum of the received audio signal. Further, Y(f) indicates the filtered frequency spectrum. As clear from formula (10), the larger the gain value, the larger the Y(f).

The filter unit 27 outputs the frequency spectrum which was enhanced by the filtering to the frequency-time conversion unit 28.

Each time receiving the frequency spectrum enhanced by the filter unit 27, the frequency-time conversion unit 28 transforms the frequency spectrum in frequency domain into time domain and thereby obtains the amplified audio signal. Note, the frequency-time conversion unit 28 uses an inverse transform of the time-frequency conversion used by the time-frequency conversion unit 26.

The frequency-time conversion unit 26 outputs the amplified audio signal to the amplifier 17.

Figure 7:
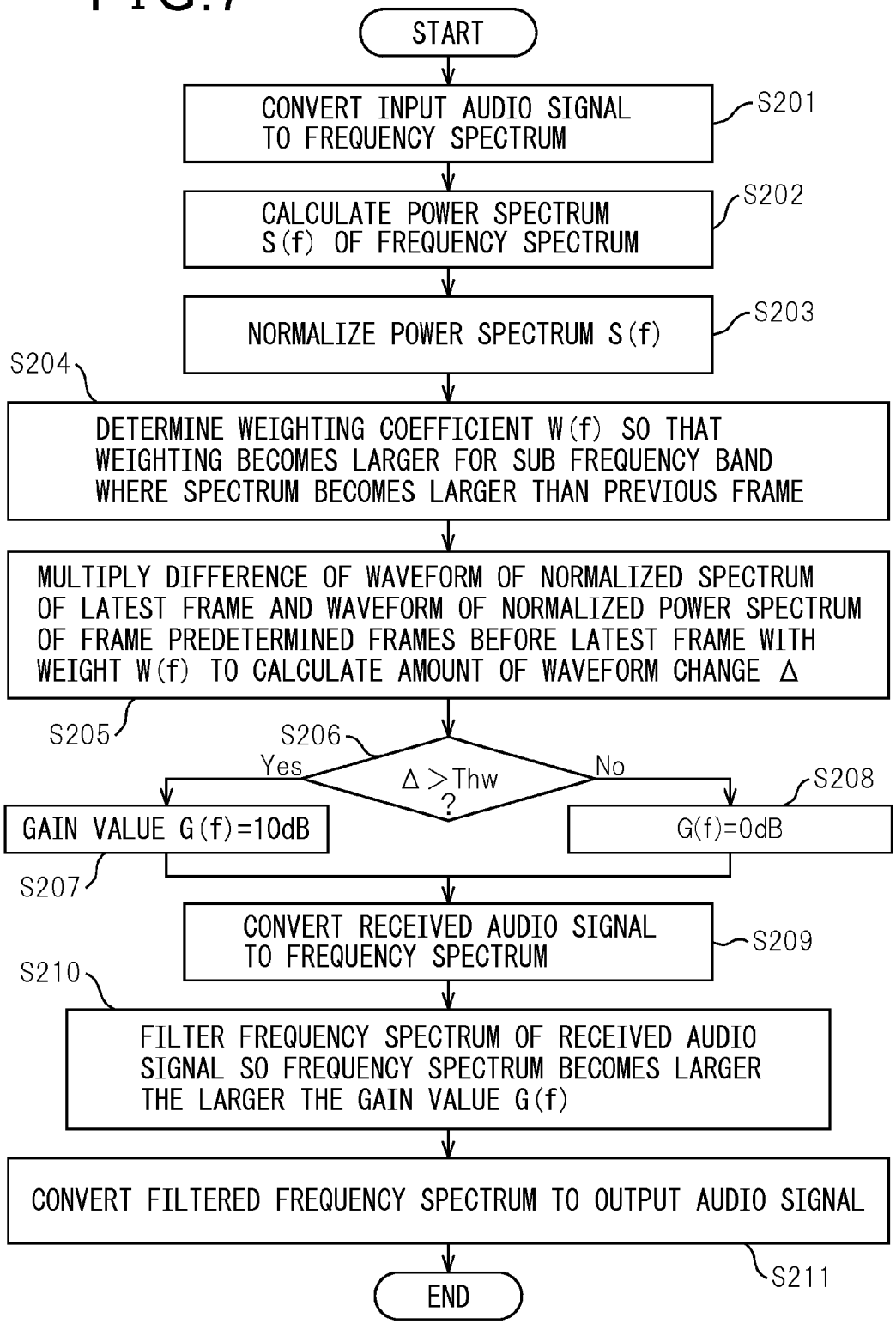
FIG. 7 is a view illustrating a flow chart of operation of enhancement of an input audio signal.

FIG. 7 is a flow chart of operation of enhancement of the audio signal which is received through the communication unit 11. Note, the audio signal processing system 21 repeatedly performs the enhancement illustrated in FIG. 7 on the input audio signal which is picked up by the microphone 12 in frame units. Further, the gain value which is mentioned in the following flow chart is an example. It may be another value as well.

First, the time-frequency conversion unit 22 converts the input audio signal to the frequency spectrum by transforming the input audio signal in time domain into frequency domain in frame units (step S201). The time-frequency conversion unit 22 transfers the frequency spectrum of the input audio signal to the power spectrum calculation unit 23.

Next, the power spectrum calculation unit 23 calculates the power spectrum S(f) of the frequency spectrum of the input audio signal which is received from the time-frequency conversion unit 22 (step S202). Further, the power spectrum calculation unit 23 outputs the calculated power spectrum S(f) to the audio signal judgment unit 24. Further, the audio signal judgment unit 24 transfers the received power spectrum S(f) to the spectral normalization unit 241 and stores it in the buffer 242.

The spectral normalization unit 241 of the audio signal judgment unit 24 normalizes the received power spectrum (step S203). Further, the spectral normalization unit 241 outputs the calculated normalized power spectrum S'(f) to the waveform change calculation unit 244 of the audio signal judgment unit 24 and stores it in the buffer 242.

Further, the weight determination unit 243 of the audio signal judgment unit 24 reads the power spectrum of the latest frame and the power spectrum of the one previous frame from the buffer 242. Further, the weight determination unit 243 determines the weighting coefficient w(f) so that the weighting coefficient for a sub frequency band where the spectrum of the latest frame becomes larger than the spectrum of the previous frame by a predetermined offset value or more becomes larger (step S204). The weight determination unit 243 outputs the weighting coefficient w(f) to the waveform change calculation unit 244.

The waveform change calculation unit 244 calculates the absolute value of the difference between the waveform of the normalized power spectrum of the latest frame and the waveform of the normalized power spectrum of the frame a predetermined number of frames before the latest frame, read from the buffer 242, for each sub frequency band. Further, the waveform change calculation unit 244 totals the values obtained by multiplying the absolute value of the difference of waveforms of each sub frequency band with the weighting coefficient w(f) to thereby calculate the amount of waveform change Δ (step S205). Further, the waveform change calculation unit 244 transfers the amount of waveform change Δ to the judgment unit 245 of the audio signal judgment unit 24.

The judgment unit 245 judges if the amount of waveform change Δ is larger than the threshold value Thw (step S206). Further, the judgment unit 245 notifies the results of judgment to the gain calculation unit 25.

When the amount of waveform change Δ is larger than a predetermined threshold value Thw (step S206-Yes), the judgment unit 245 judges that babble noise is contained, so the gain calculation unit 25 sets the gain value G(f) to 10 dB (step S207). On the other hand, when the amount of waveform change Δ is a predetermined threshold value Thw or less (step S206-No), the judgment unit 245 judges that no babble noise is included, so the gain calculation unit 25 sets the gain value G(f) to 0 dB (step S208).

After step S207 or S208, the gain calculation unit 25 outputs the gain value G(f) to the filter unit 27.

Further, the time-frequency conversion unit 26 converts the received audio signal to the frequency spectrum by transforming the received audio signal in time domain into frequency domain in frame units (step S209). The time-frequency conversion unit 26 outputs the frequency spectrum of the received audio signal to the filter unit 27.

The filter unit 27 performs filtering for the frequency spectrum of the received audio signal for each sub frequency band so that the larger the frequency spectrum, the larger the gain value G(f) (step S210). Further, the filter unit 27 outputs the filtered frequency spectrum to the frequency-time conversion unit 28.

The frequency-time conversion unit 28 converts the frequency spectrum of the filtered received audio signal to the output audio signal by transforming the frequency spectrum in frequency domain into time domain (step S211). Further, the frequency-time conversion unit 28 outputs the amplified output audio signal to the amplifier 17.

As explained above, the audio signal processing system according to the second embodiment judges that an audio signal contains babble noise when the waveform of the normalized power spectrum of the input audio signal greatly fluctuates in a short time period and thereby can accurately detect babble noise. Further, the telephone in which this audio signal processing system is mounted amplifies the received audio signal when it is judged that babble noise is contained and therefore can facilitate understanding of the received speech even if the area around the telephone is noisy.

Next, an audio signal processing system according to a third embodiment will be explained.

This audio signal processing system, in the same way as the audio signal processing system according to the second embodiment, examines the change over time of the waveform of the frequency spectrum of the audio signal which obtained by using a microphone to pick up the sound around the telephone in which the audio signal processing system is mounted. Further, this audio signal processing system suitably adjusts the volume of the reproduced sound by amplifying the power of the separately obtained audio signal to be reproduced the larger the amount of waveform change.

A telephone in which the audio signal processing system according to the third embodiment is mounted has a configuration similar to the telephone 2 according to the second embodiment illustrated in FIG. 5.

Figure 8:
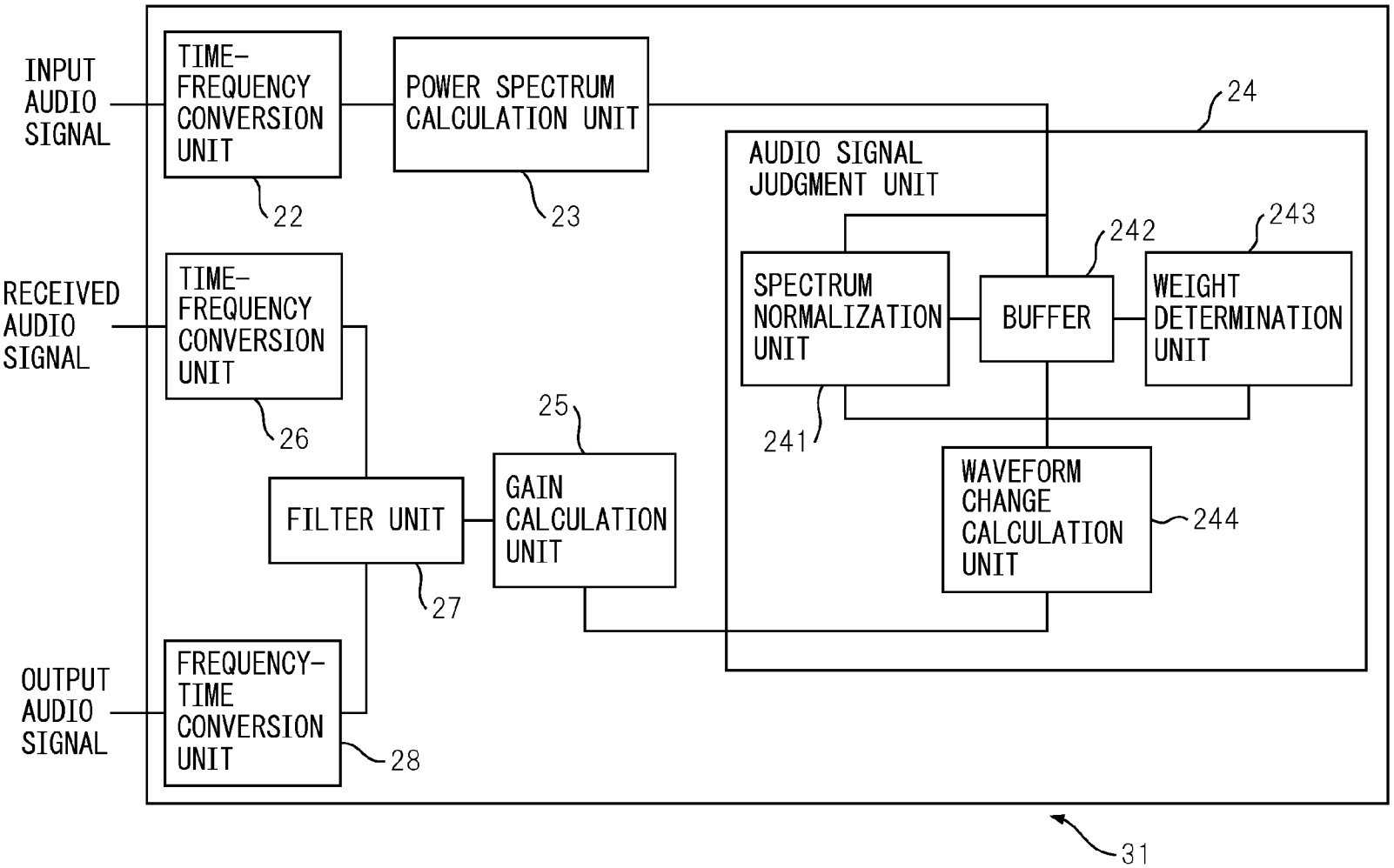
FIG. 8 is a schematic view of the configuration of an audio signal processing system according to a third embodiment.

FIG. 8 is a schematic view of the configuration of an audio signal processing system 31 according to the third embodiment. As illustrated in FIG. 8, the audio signal processing system 31 includes time-frequency conversion units 22 and 26, a power spectrum calculation unit 23, an audio signal judgment unit 24, a gain calculation unit 25, a filter unit 27, and a frequency-time conversion unit 28. Note, the components of the audio signal processing system 31 illustrated in FIG. 8 are assigned the same reference numerals as corresponding components of the audio signal processing system 21 illustrated in FIG. 6.

The components of the audio signal processing system 31 are formed as separate circuits. Alternatively, the components of the audio signal processing system 31 may also be mounted in the audio signal processing system 31 as a single integrated circuit on which circuits corresponding to these components are integrated. Further, the components of the audio signal processing system 31 may also be functional modules which are realized by a computer program which is run on a processor of the audio signal processing system 31.

The audio signal processing system 31 illustrated in FIG. 8 differs from the audio signal processing system 21 according to the second embodiment in the point that the audio signal judgment unit 24 does not include a judgment unit 245 and the amount of waveform change is directly output to the gain calculation unit 25 and the point that the gain calculation unit 25 determines the gain based on the amount of waveform change. Therefore, below, calculation of the gain value will be explained.

The gain calculation unit 25, when receiving the amount of waveform change Δ from the audio signal judgment unit 24, determines the gain value in accordance with a gain determining function which expresses the relationship between the amount of waveform change Δ and the gain value G(f). The gain determining function is a function by which the larger the amount of waveform change Δ, the larger the gain value G(f). For example, the gain determining function may also be a function where the gain value G(f) also linearly increases as the amount of waveform change Δ becomes greater in the case where the amount of waveform change Δ is included in a range from the predetermined lower limit value $Thw_{low}$ to the predetermined upper limit value $Thw_{high}$. Further, with this gain determining function, when the amount of waveform change Δ is the lower limit value $Thw_{low}$ or less, the gain value G(f) is 0, while when the amount of waveform change Δ is the upper limit value $Thw_{high}$ or more, the gain value G(f) becomes the maximum gain value $G_{max}$. Note, the lower limit value $Thw_{low}$ corresponds to the minimum value of the amount of waveform change which has the possibility of being babble noise, for example, is set to 3 dB. Further, the upper limit value $Thw_{high}$ corresponds to an intermediate value of the amount of waveform change due to sound other than noise and the amount of waveform change due to babble noise and, for example, is set to 6 dB. Further, the maximum gain value $G_{max}$ is the value for amplifying the received audio signal to an extent where the user of the telephone 2 can sufficiently understand the received signal even if people are talking around the telephone 2 and, for example, is set to 10 dB.

Note, the gain determining function may also be a nonlinear function. For example, the gain determining function may also be a function where the gain value G(f) becomes larger proportional to the square of the amount of waveform change Δ or the log of the amount of waveform change Δ when the amount of waveform change Δ is included in the range from the lower limit value $Thw_{low}$ to the upper limit value $Thw_{high}$.

Further, the gain calculation unit 25 may also apply the gain value which is determined by the gain determining function to only the frequency band corresponding to the human voice and, for the other frequency bands, make the gain value a value smaller than the gain value which is determined by the gain determining function, for example, 0 dB. Due to this, the audio signal processing system 3 can selectively amplify just the audio signal of the frequency band corresponding to the human voice in the received audio signal. In particular, by having the gain calculation unit 25 selectively amplify the received audio signal corresponding to the high frequency band in the human voice, it is possible to facilitate understanding of the received audio signal by the user. Note, the high frequency band in the human voice is, for example, 2 kHz to 4 kHz.

As explained above, the audio signal processing system according to the third embodiment increases the power of the received audio signal the more the waveform of the normalized power spectrum of the input audio signal fluctuates. For this reason, this audio signal processing system can suitably adjust the volume of the received audio signal in accordance with the babble noise around the telephone.

Next, the audio signal processing system according to the fourth embodiment will be explained.

This audio signal processing system executes active noise control on the noise around the telephone in which the audio signal processing system is mounted and thereby generates reverse phase sound of the sound around the telephone from the speaker of the telephone so as to cancel out the noise around the telephone. Further, this audio signal processing system generates a reverse phase sound using a different filter in accordance with whether or not babble noise is included when generating the reverse phase sound. Further, this audio signal processing system superposes the reverse phase sound over the received sound for reproduction from the speaker to thereby suitably cancel out noise even if the noise around the telephone is babble noise.

The telephone in which the audio signal processing system according to the fourth embodiment is mounted has a configuration similar to the telephone 2 according to the second embodiment illustrated in FIG. 5.

Figure 9:
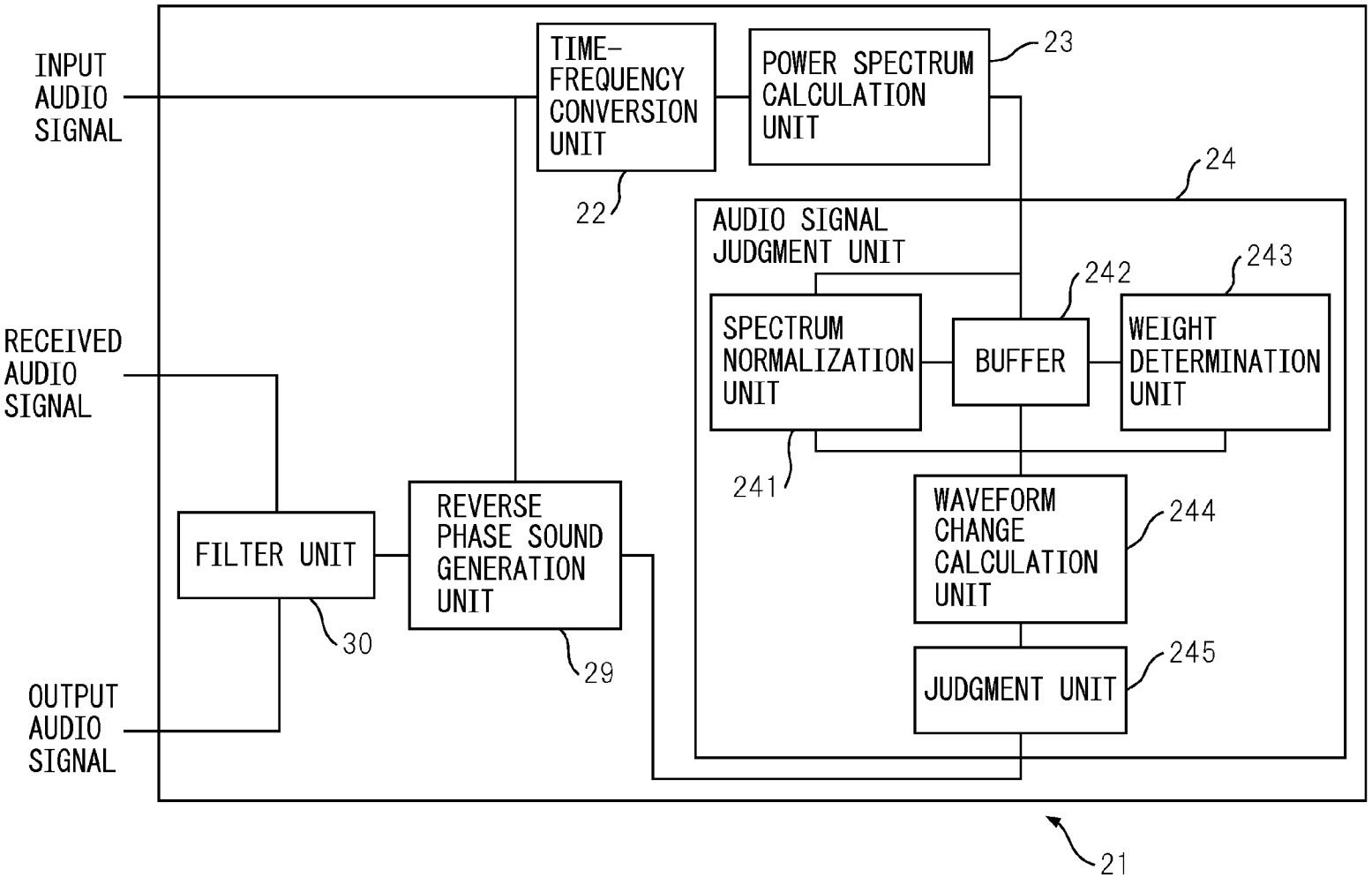
FIG. 9 is a schematic view of the configuration of an audio signal processing system according to a fourth embodiment.

FIG. 9 is a schematic view of the configuration of an audio signal processing system 41 according to a fourth embodiment. As illustrated in FIG. 9, the audio signal processing system 41 includes a time-frequency conversion unit 22, a power spectrum calculation unit 23, an audio signal judgment unit 24, a reverse phase sound generation unit 29, and a filter unit 30. Note, the components of the audio signal processing system 41 illustrated in FIG. 9 are assigned the same reference numerals of the corresponding components of the audio signal processing system 21 illustrated in FIG. 6.

The components of the audio signal processing system 41 are formed as separate circuits. Alternatively, the components of the audio signal processing system 41 may also be mounted in the audio signal processing system 31 as a single integrated circuit on which circuits corresponding to these components are integrated. Further, the components of the audio signal processing system 41 may also be functional modules which are realized by a computer program which is run on a processor of the audio signal processing system 41.

The audio signal processing system 41 illustrated in FIG. 9 differs from the audio signal processing system 21 according to the second embodiment on the point that the reverse phase sound generation unit 29 generates the reverse phase sound of the input audio signal and the filter unit 27 superposes the reverse phase sound on the received audio signal. Therefore, below, the reverse phase sound generation unit 29 and filter unit 30 will be explained.

The reverse phase sound generation unit 29 generates a reverse phase sound for the input audio signal corresponding to the sound around the telephone which is picked up through the microphone 12. For example, the reverse phase sound generation unit 29 filters the input audio signal x[n] by the following formula to generate a reverse phase sound d[n].

$$d[n] = \sum_{i=0}^{L} (a[i] \cdot x[n-i]) \text{case where babble noise is included} \tag{11}$$

$$d[n] = \sum_{i=0}^{L} (\beta[i] \cdot x[n-i]) \text{case where babble noise is not included}$$

Note, α[i] and β[i] (i=1, 2, . . . , L) are finite impulse response (FIR) type filters which are prepared in advance considering the signal propagation characteristics of the telephone 2 for an input audio signal. Further, L indicates the number of taps and is set to any finite positive integer.

Here, the filter α[i] is a filter which is used when it is judged that an input audio signal contains babble noise, while the filter β[i] is a filter which is used when it is judged that an input audio signal does not contain babble noise. The filter α[i] is preferably designed so that the absolute value of the reverse phase sound d[n] which is generated using the filter α[i] becomes smaller than the absolute value of the reverse phase sound d[n] which is generated using the filter β[i]. If the filter is designed so as to generate a reverse phase sound d[n] which is completely reverse from the phase and amplitude of the input audio signal x[n], the amplitude of d[n] becomes larger than the amplitude of x[n] when the input audio signal rapidly changes. This reverse phase sound is liable to become an odd sound to the user. Therefore, the reverse phase sound generation unit 29 can prevent the generation of an odd sound due to the reverse phase sound by making the reverse phase sound d[n] for the babble noise where the characteristics of the sound fluctuate in a short time period smaller than the reverse phase sound d[n] generated using the filter β[i]. Note, if the reverse phase sound is small, the babble noise sometimes cannot be completely cancelled out. However, if the reverse phase sound can be used to cancel out even part of the babble noise, the user can more easily understand the received audio signal.

Alternatively, the reverse phase sound generation unit 29 may find an FIR adaptive filter for outputting a signal with a phase inverted from the input audio signal. In this case, the reverse phase sound generation unit 29 also includes the function as a filter updating unit. Further, the reverse phase sound generation unit 29 generates reverse phase sound by filtering the input audio signal using the determined adaptive filter.

The reverse phase sound generation unit 29 can find the FIR adaptive filter by, for example, the steepest descent method or filtered x LMS method so that the error signal which is measured by an error mike etc. becomes minimum.

Here, when the input audio signal includes babble noise, as explained in relation to FIG. 2A and FIG. 2B, the waveform of the frequency spectrum of the input audio signal greatly fluctuates in a short time period. That is, the intensity of the input audio signal, the level of the frequency, or other characteristics fluctuate in a short time period. Therefore, the reverse phase sound generation unit 29 preferably makes the number of taps of the FIR adaptive filter when the audio signal judgment unit 24 judges that the input audio signal contains babble noise shorter than the reverse phase sound when it judges that the input audio signal does not contain babble noise. For example, when the number of taps of the FIR adaptive filter when it is judged that the input audio signal contains babble noise is set to half of the number of taps of the FIR adaptive filter when it is judged that the input audio signal does not contain babble noise. Due to this, the reverse phase sound generation unit 29 can prepare a suitable FIR adaptive filter even when the input audio signal contains babble noise.

The reverse phase sound generation unit 29 outputs the generated reverse phase sound to the filter unit 30.

The filter unit 30 superposes the reverse phase sound on the received audio signal. Further, the filter unit 30 outputs the received audio signal on which the reverse phase sound is superposed to the amplifier 17.

As explained above, the audio signal processing system according to the fourth embodiment examines the change along with time of the waveform of the frequency spectrum of the input audio signal obtained by the microphone picking up the sound around the telephone in which the audio signal processing system is mounted so as to judge if babble noise is included. Further, this audio signal processing system makes the amplitude of the reverse phase sound when the input audio signal contains babble noise smaller than the amplitude of the reverse phase sound when the input audio signal does not contain babble noise. Alternatively, this audio signal processing system can make the number of taps of the FIR adaptive filter for generating the reverse phase sound when the input audio signal contains babble noise smaller than the case where the input audio signal does not contain babble noise. Due to this, this audio signal processing system can generate a suitable reverse phase sound when the input audio signal contains babble noise. For this reason, the telephone in which this audio signal processing system is mounted can suitably cancel out babble noise even if there is babble noise around the telephone.

Note, the present application is not limited to the above embodiment. For example, the audio signal processing system according to the fourth embodiment may be mounted in an audio reproduction device which reproduces audio signal data stored in a recording medium. In this case, the audio signal processing system may receive as input, instead of the received audio signal, an audio signal which is reproduced from audio signal data which is stored in the recording medium.

Further, the audio signal processing system according to the first embodiment may include a weight determination unit similar to the weight determination unit of the audio signal processing system according to the second embodiment. In this case, the waveform change calculation unit of the audio signal processing system according to the modification of the first embodiment calculates the amount of waveform change in accordance with formula (9).

Furthermore, the gain calculation unit of the audio signal processing system according to the first embodiment, like the audio signal processing system according to the third embodiment, may also determine the gain value so that the gain value becomes a larger value as the amount of waveform change increases. In this case, to determine the reference value for judging if a power spectrum is a noise component, the bias value which is added to the estimated noise spectrum is used only the babble noise bias value Bb or bias value Bc.

Further, the audio signal processing systems of the above embodiments may also normalize not the power spectrum, but the frequency spectrum itself and calculate the amount of waveform change between two normalized frequency spectrums so as to judge the type of the noise contained in the audio signal. In this case, the spectral normalization unit inputs the frequency spectrum instead of the power spectrum into formula (4) or formula (5) so as to calculate the normalized frequency spectrum. Further, the threshold values which are determined for the power spectrum are modified to values determined for the frequency spectrum. Further, the power spectrum calculation unit is omitted.

Further, the audio signal processing systems according to the above embodiments may also perform the above noise reduction processing, received audio amplification processing, or noise cancellation processing for each channel when the input audio signal has a plurality of channels.

Further, the computer program including functional modules for realizing the functions of the components of the audio signal processing system according to the above embodiments may also be distributed in the form of storage in magnetic recording media, optical storage medium, and other recording media.

All examples and conditional language recited here are intended for pedagogical purposes to aid the reader in understanding the principles of the invention and the concepts contributed by the inventor to furthering the art and are to be construed as being without limitation to such specifically recited examples and conditions nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. An audio signal processing system, including a processor, comprising:

a time-frequency conversion unit which converts an audio signal in time domain into frequency domain in frame units so as to calculate a frequency spectrum of the audio signal;

a weight determination unit which sets a weighting coefficient of a subfrequency band where an amplitude of a frequency spectrum of the subfrequency band of a first frame is larger than the amplitude of the frequency spectrum of the subfrequency band of a second frame before the first frame, among subfrequency bands obtained by dividing a frequency band, larger than the weighting coefficient of the subfrequency band where the amplitude of the frequency spectrum of the subfrequency band of the first frame is not larger than the amplitude of the frequency spectrum of the subfrequency band of the second frame;

a spectral change calculation unit which calculates an amount of change of the frequency spectrum of the first frame and the frequency spectrum of the second frame by totaling up a value of the weighting coefficient multiplied with an absolute value of a corresponding difference of a normalized spectrum of the first frame and the normalized spectrum of the second frame for each subfrequency band; and a judgment unit which judges the type of the noise which is included in the audio signal of the first frame in accordance with the amount of spectral change.

2. The audio signal processing system according to claim 1, wherein the judgment unit judges that the type of the noise which is included in the audio signal of the first frame is noise of a plurality of human voices combined when the amount of spectral change is larger than a first threshold value corresponding to the amount of spectral change for one human voice.

3. The audio signal processing system according to claim 1, further comprising:

a gain calculation unit which calculates a gain according to the amount of spectral change as judged by the judgment unit;

a filter unit which calculates a noise reducing spectrum by multiplying the gain with the frequency spectrum, and a frequency-time conversion unit which converts the noise reducing spectrum to a time signal to calculate an output signal, and wherein the gain calculation unit makes the gain when the type of the noise which is included in the audio signal of the first frame is judged by the judgment unit to be noise comprised of a plurality of human voices combined larger than the gain when the type of the noise which is included in the audio signal of the first frame is judged not to be noise comprised of a plurality of human voices combined.

4. The audio signal processing system according to claim 2, further comprising:

a gain calculation unit which calculates a gain in accordance with the output from the judgment unit;

a filter unit which multiplies the gain with the frequency spectrum to calculate the noise reducing spectrum; and a frequency-time conversion unit which converts a noise reducing spectrum to a time signal to calculate an output signal, and wherein the gain calculation unit makes the second threshold value when the type of the noise which is included in the audio signal of the first frame is noise comprised of a plurality of human voices combined, larger than the second threshold value when the type of the noise which is included in the audio signal of the first frame is judged not to be noise comprised of the plurality of human voices combined.

5. The audio signal processing system according to claim 2, further comprising:

a second time-frequency conversion unit which converts a second audio signal in time domain into frequency domain in frame units to calculate the frequency spectrum of the second audio signal;

a gain calculation unit which calculates a gain for each band for amplification of the input signal based on the results of judgment of noise;

a filter unit which multiples the gain for each band with the frequency spectrum of the second audio signal to calculate an enhanced spectrum; and a frequency-time conversion unit which converts the enhanced spectrum to a time signal to calculate an output signal, and wherein the gain calculation unit sets the gain when the type of the noise which is included in the audio signal of the first frame is judged by the judgment unit to be noise comprised of a plurality of human voices combined, larger than the gain when the type of the noise which is included in the audio signal of the first frame is judged not to be noise comprised of a plurality of human voices combined.

6. The audio signal processing system according to claim 2, further comprising:

a reverse phase sound generation unit which applies a preset filter to the audio signal to generate a reverse phase sound of the audio signal; and a filter unit which superposes the reverse phase sound on a second audio signal, and wherein the reverse phase sound generation unit holds a preset plurality of filters and switches use of filters in the case where the type of the noise which is included in the audio signal of the first frame is judged by the judgment unit to be noise of a plurality of human voice combined and in other cases.

7. The audio signal processing system according to claim 2, further comprising:

a reverse phase sound generation unit which applies a filter to the audio signal to generate a reverse phase sound of the audio signal;

a filter updating unit which updates the filter based on an error signal; and a filter unit which superposes the reverse phase sound on a second audio signal, and wherein the reverse phase sound generation unit holds a plurality of filters and switches use of filters in the case where the type of the noise which is included in the audio signal of the first frame is judged by the judgment unit to be noise of a plurality of human voice combined and in other cases, and the filter updating unit updates the filter which is used by the reverse phase sound generation unit.

8. The audio signal processing system according to claim 1, further comprising:

a gain calculation unit which sets a gain larger the larger the amount of spectral change; and a filter unit which performs filtering to increase an input second audio signal separate from the audio signal the larger the gain.

9. An audio signal processing method comprising:

converting an audio signal in time domain into frequency domain in frame units so as to calculate the frequency spectrum of the audio signal;

setting a weighting coefficient of a subfrequency band where an amplitude of a frequency spectrum of the subfrequency band of a first frame is larger than the amplitude of the frequency spectrum of the subfrequency band of a second frame before the first frame, among subfrequency bands obtained by dividing a frequency band, larger than the weighting coefficient of the subfrequency band where the amplitude of the frequency spectrum of the subfrequency band of the first frame is not larger than the amplitude of the frequency spectrum of the subfrequency band of the second frame;

calculating, in a processor, the amount of change between the frequency spectrum of the first frame and the frequency spectrum of the second frame by totaling up a value of the weighting coefficient multiplied with an absolute value of a corresponding difference of a normalized spectrum of the first frame and the normalized spectrum of the second frame for each subfrequency band; and judging the type of the noise which is included in the audio signal of the first frame in accordance with the amount of spectral change.

10. An audio signal processing system, including a processor, comprising:

a time-frequency conversion unit which converts an audio signal in time domain into frequency domain in frame units so as to calculate a frequency spectrum of the audio signal;

a spectral change calculation unit which calculates an amount of change of a frequency spectrum of a first frame and the frequency spectrum of a second frame before the first frame based on a total of absolute values of a difference of a normalized spectrum of the first frame and the normalized spectrum of the second frame of each of a plurality of subfrequency bands obtained by dividing a frequency band;

a judgment unit which judges that a type of noise included in the audio signal of the first frame is the noise of a plurality of human voices combined when the amount of spectral change is larger than a first threshold value;

a second time-frequency conversion unit which converts a second audio signal in the time domain into the frequency domain in the frame units to calculate the frequency spectrum of the second audio signal;

a gain calculation unit which calculates a gain for each band for amplification of an input signal based on results of the judgment unit;

a filter unit which multiples the gain for each band with the frequency spectrum of the second audio signal to calculate an enhanced spectrum; and a frequency-time conversion unit which converts the enhanced spectrum to a time signal to calculate an output signal, wherein the gain calculation unit sets the gain when the type of the noise which is included in the audio signal of the first frame is judged by the judgment unit to be the noise comprised of a plurality of human voices combined, larger than the gain when the type of the noise which is included in the audio signal of the first frame is judged not to be the noise comprised of the plurality of human voices combined, and as the gain is larger, the enhanced spectrum is amplified, wherein the amount of spectral change is obtained by multiplying a weighting coefficient by the absolute value of the difference of the normalized spectrum for each subfrequency band and totaling the multiplied results over the plurality of subfrequency bands, and wherein the weighting coefficient is larger when an amplitude of the frequency spectrum of a subfrequency band is greater than the amplitude of the frequency spectrum of the subfrequency band of the previous frame.

* * * * *